US006564490B1

(12) United States Patent
Avila

(10) Patent No.: US 6,564,490 B1
(45) Date of Patent: May 20, 2003

(54) PICTURE PLANT ASSEMBLY

(76) Inventor: Omar Avila, 9420 SW. 30 Ter., Miami, FL (US) 33165

( * ) Notice: Subject to any disclaimer, the term of this patent is extended or adjusted under 35 U.S.C. 154(b) by 0 days.

(21) Appl. No.: 09/802,567

(22) Filed: Mar. 9, 2001

(51) Int. Cl.[7] ..... A47G 7/00

(52) U.S. Cl. ..... 40/745; 40/661.11; 40/645; 47/41.01; D6/306; 428/13

(58) Field of Search ..... 40/645, 661.11, 40/745, 607; 47/39, 41.01, 41.11, 41.17; D6/306; 428/13

(56) References Cited

U.S. PATENT DOCUMENTS

| | | | | | |
|---|---|---|---|---|---|
| 1,562,992 | A | * | 11/1925 | Schling | 47/41.11 |
| 1,808,292 | A | * | 6/1931 | Coppersmith | 40/645 |
| D119,616 | S | * | 3/1940 | Fuerst | D11/149 |
| 2,759,285 | A | * | 8/1956 | Bussert | 428/13 |
| D198,040 | S | | 4/1964 | Bonham et al. | |
| 3,245,175 | A | | 4/1966 | Klingberg | |
| 3,368,303 | A | * | 2/1968 | Tong | 47/47 |
| 3,447,262 | A | * | 6/1969 | Uhl | 47/41.11 |
| 3,498,520 | A | * | 3/1970 | Zumpel | 206/589 |
| 4,143,191 | A | * | 3/1979 | Chavis | 428/13 |
| 4,375,288 | A | | 3/1983 | Guertin | |
| D273,312 | S | | 4/1984 | Guertin | |
| 5,246,374 | A | | 9/1993 | Boodram | |
| D368,233 | S | * | 3/1996 | Spickelmier | D11/117 |
| 5,870,856 | A | | 2/1999 | Friend | |

* cited by examiner

*Primary Examiner*—Cassandra H. Davis

(57) ABSTRACT

A picture plant assembly for providing an ornamental and attractive method of displaying photographs. The picture plant assembly includes a holder assembly including a base container having an open top and a bottom wall; and also includes a plurality of stems being removably disposed in the base container; and further includes a plurality of picture frames being removably attached to the stems and being adapted to support pictures.

5 Claims, 1 Drawing Sheet

PICTURE PLANT ASSEMBLY

BACKGROUND OF THE INVENTION

1. Field of the Invention

The present invention relates to a plant-like picture arrangement and more particularly pertains to a new picture plant assembly for providing an ornamental and attractive method of displaying photographs.

2. Description of the Prior Art

The use of a plant-like picture arrangement is known in the prior art. More specifically, a plant-like picture arrangement heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,246,374; U.S. Pat. No. 3,245,175; U.S. Pat. No. 4,375,288; U.S. Pat. No. Des. 273,312; U.S. Pat. No. Des. 368,233; U.S. Pat. No. Des. 198,040; and U.S. Pat. No. 5,870,856.

While these devices fulfill their respective, particular objectives and requirements, the aforementioned patents do not disclose a new picture plant assembly. The inventive device includes a holder assembly including a base container having an open top and a bottom wall; and also includes a plurality of stems being removably disposed in the base container; and further includes a plurality of picture frames being removably attached to the stems and being adapted to support pictures.

In these respects, the picture plant assembly according to the present invention substantially departs from the conventional concepts and designs of the prior art, and in so doing provides an apparatus primarily developed for the purpose of providing an ornamental and attractive method of displaying photographs.

SUMMARY OF THE INVENTION

In view of the foregoing disadvantages inherent in the known types of plant-like picture arrangement now present in the prior art, the present invention provides a new picture plant assembly construction wherein the same can be utilized for providing an ornamental and attractive method of displaying photographs.

The general purpose of the present invention, which will be described subsequently in greater detail, is to provide a new picture plant assembly which has many of the advantages of the plant-like picture arrangement mentioned heretofore and many novel features that result in a new picture plant assembly which is not anticipated, rendered obvious, suggested, or even implied by any of the prior art plant-like picture arrangement, either alone or in any combination thereof.

To attain this, the present invention generally comprises a holder assembly including a base container having an open top and a bottom wall; and also includes a plurality of stems being removably disposed in the base container; and further includes a plurality of picture frames being removably attached to the stems and being adapted to support pictures.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new picture plant assembly which has many of the advantages of the plant-like picture arrangement mentioned heretofore and many novel features that result in a new picture plant assembly which is not anticipated, rendered obvious, suggested, or even implied by any of the prior art plant-like picture arrangement, either alone or in any combination thereof.

It is another object of the present invention to provide a new picture plant assembly which may be easily and efficiently manufactured and marketed.

It is a further object of the present invention to provide a new picture plant assembly which is of a durable and reliable construction.

An even further object of the present invention is to provide a new picture plant assembly which is susceptible of a low cost of manufacture with regard to both materials and labor, and which accordingly is then susceptible of low prices of sale to the consuming public, thereby making such picture plant assembly economically available to the buying public.

Still yet another object of the present invention is to provide a new picture plant assembly which provides in the apparatuses and methods of the prior art some of the advantages thereof, while simultaneously overcoming some of the disadvantages normally associated therewith.

Still another object of the present invention is to provide a new picture plant assembly for providing an ornamental and attractive method of displaying photographs.

Yet another object of the present invention is to provide a new picture plant assembly which includes a holder assembly including a base container having an open top and a bottom wall; and also includes a plurality of stems being removably disposed in the base container; and further includes a plurality of picture frames being removably attached to the stems and being adapted to support pictures.

Still yet another object of the present invention is to provide a new picture plant assembly that is easy and convenient to use and set up and to interchange the pictures as desired by the user.

Even still another object of the present invention is to provide a new picture plant assembly that allows the user to set up the pictures with a very sturdy and reliable base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
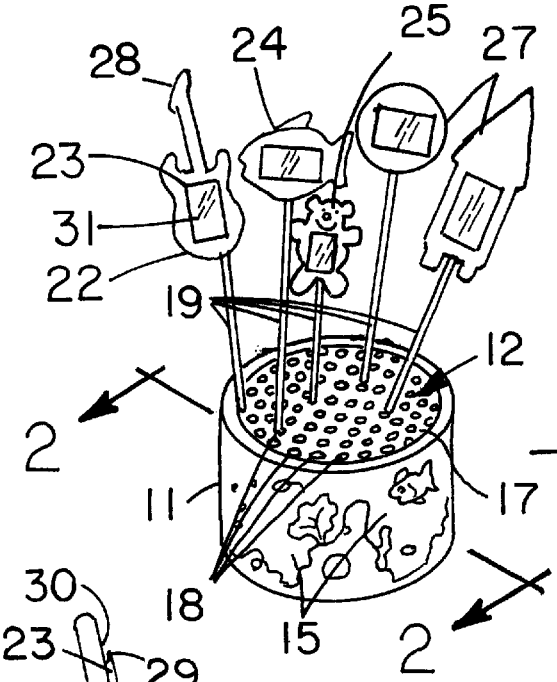
FIG. 1 is a perspective view of a new picture plant assembly according to the present invention.
Figure 2:
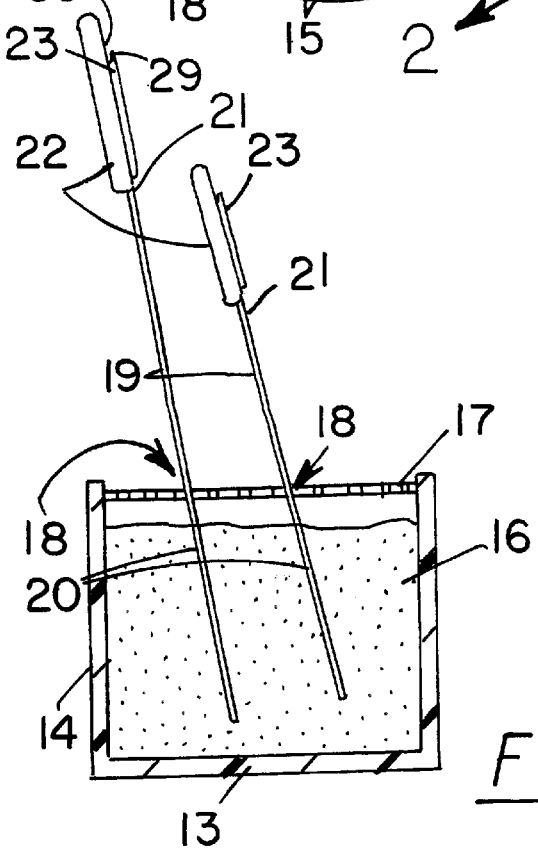
FIG. 2 is a cross-sectional view of the present invention.
Figure 3:
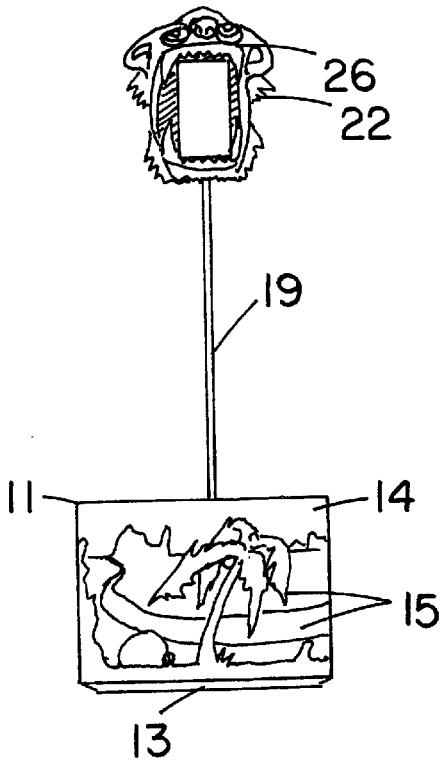
FIG. 3 is a front elevational view of the present invention.

With reference now to the drawings, and in particular to FIGS. 1 through 3 thereof, a new picture plant assembly embodying the principles and concepts of the present invention and generally designated by the reference numeral 10 will be described.

As best illustrated in FIGS. 1 through 3, the picture plant assembly 10 generally comprises a holder assembly including a base container 11 having an open top 12 and a bottom wall 13. The base container 11 also includes decorations 15 of various themes being conventionally displayed upon a side wall 14 thereof. The holder a holder assembly including a base container 11 having an open top 12 and a bottom wall 13. The base container 11 also includes decorations 15 of various themes being conventionally displayed upon a side wall 14 thereof. The holder assembly further includes particulate substance 16 being disposed in the base container 11 for providing weight to the base container 11. The particulate substance 16 is generally sand.

A plurality of elongate support members 19 is removably positionable in the base container 11.

The holder assembly also includes a positioning member 17 for positioning each of the elongate support members 19 about the open end of the base container 11. The positioning member 17 is disposed in the base container 11 near the open top 12 thereof and above the particulate substance 16.

The positioning member 17 has a plurality of substantially circular holes 18 extending therethrough for receiving the elongate support members 19. Each of the holes 18 are spaced apart a distance generally greater than a diameter of the holes 18 for the purpose of adequately spacing each of the elongate support members 19 about the base container 11.

A plurality of picture support members 22 is mounted on top end portions 21 of the elongate support members 19.

Included is a plurality of picture frames 23 for holding pictures 29. Each of the picture frames 23 is mounted on a front side 30 of one each of the picture support members 22 and includes a substantially transparent front member 31.

Each of the elongate support members 19 has a bottom end portion 20 that is passable through the holes 18 of the positioning member 17 and is selectively positionable in the particulate substance 16 such that each of the support members is held in a manner so as to most efficiently display the pictures 29 positioned in the picture frames 23.

The picture support members 22 have unique ornamental shapes including sea creatures 24, animals 25, airplanes, boats, music instruments 28, outer space objects 27, rockets, and art deco 26.

I claim:

1. A picture plant assembly comprising:

a holder assembly including a base container having an open top and a bottom wall;

a plurality of elongate support members being removably positionable in said base container;

a plurality of picture support members being mounted on top end portions of said elongate support members;

a plurality of picture frames for holding pictures, each of said picture frames being mounted on a front side of one each of said picture support members and including a substantially transparent front member;

a particulate substance positioned in said base container;

wherein said holder assembly also includes a positioning member for positioning each of said elongate support members about said open end of said base container, said positioning member being disposed in said base container near said open top thereof and in spaced relationship above said particulate substance for enhancing free movement of particles in a top layer of said particulate substance to facilitate insertion of said picture support members into said particulate substance;

wherein said positioning member has a plurality of substantially circular holes extending therethrough for receiving said elongate support members, each of said holes being spaced apart a distance generally greater than a diameter of said holes for the purpose of adequately spacing each of said elongate support members about said base container;

wherein each of said elongate support members has a bottom portion being passable through said holes of said positioning member and being selectively positionable in said particulate substance such that each of said support members is held in a manner so as to most efficiently display the pictures positioned in the picture frames.

2. A picture plant assembly as described in claim 1, wherein said base container includes decorations of various themes being displayed upon a side wall thereof.

3. A picture plant assembly as described in claim 1, wherein said particulate substance is generally sand.

4. A picture plant assembly as described in claim 1, wherein said picture support members have unique ornamental shapes selected from the group consisting of sea creatures, animals, airplanes, boats, music instruments, outer space objects, rockets, and art deco.

5. A picture plant assembly comprising:

a holder assembly including a base container having an open top and a bottom wall;

a plurality of elongate support members being removably positionable in said base container;

a plurality of picture support members being mounted on top end portions of said elongate support members;

a plurality of picture frames for holding pictures, each of said picture frames being mounted on a front side of one each of said picture support members and including a substantially transparent front member;

said base container including decorations of various themes being displayed upon a side wall thereof;

said holder assembly further including particulate substance being disposed in said base container for providing weight to said base container, said particulate substance comprising sand;

a positioning member for positioning each of said elongate support members about said open end of said base container, said positioning member being disposed in said base container near said open top thereof and above said particulate substance;

said positioning member having a plurality of substantially circular holes extending therethrough for receiving said elongate support members, each of said holes being spaced apart a distance generally greater than a diameter of said holes for the purpose of adequately spacing each of said elongate support members about said base container;

each of said elongate support members having a bottom portion being passable through said holes of said positioning member and being selectively positionable in said particulate substance such that each of said support members is held in a manner so as to most efficiently display the pictures positioned in the picture frames; and wherein said picture support members have unique ornamental shapes selected from the group consisting of sea creatures, animals, airplanes, boats, music instruments, outer space objects, rockets, and art deco.

* * * * *